United States Patent [19]

Uchida et al.

[11] Patent Number: 5,052,961

[45] Date of Patent: Oct. 1, 1991

[54] COWLING ASSEMBLY FOR OUTBOARD MOTOR

[75] Inventors: Tatsuki Uchida; Katsumi Torigai, both of Hamamatsu, Japan

[73] Assignee: Sanshin Kogyo Kabushiki Kaisha, Hamamatsu, Japan

[21] Appl. No.: 443,906

[22] Filed: Nov. 30, 1989

[30] Foreign Application Priority Data

Dec. 1, 1988 [JP] Japan ..... 63-302275

[51] Int. Cl.[5] ..... B63H 21/24

[52] U.S. Cl. ..... 440/77; 440/900

[58] Field of Search ..... 440/76, 77, 900; 123/195 P; 180/68.2

[56] References Cited

U.S. PATENT DOCUMENTS

| | | | |
|---|---|---|---|
| 1,872,184 | 8/1932 | Ragsdale | 180/69.2 |
| 3,773,010 | 11/1973 | Elingson | 440/77 |
| 4,403,971 | 9/1983 | Kobayashi et al. | 440/88 |
| 4,661,076 | 4/1987 | Iwai | 440/900 X |
| 4,869,693 | 9/1989 | Curtis et al. | 440/77 |

*Primary Examiner*—Ed Swinehart

*Attorney, Agent, or Firm*—Ernest A. Beutler

[57] ABSTRACT

Six embodiments of a cowling assembly for a powerhead of an outboard motor are provided which include a top cover divided into a center cowling emmber, and removable front and rear cowling members, or alternatively, two removable side cowling members. Each of these embodiments provides a cowling assembly which can be easily removed or opened to permit convenient servicing of the engine, and which prevents water from entering into the interior of the cowling. In the first two embodiments, the front and rear cowling members, or alternatively the two side cowling members, are connected to the center cowling member by elastic bands. Instead of using elastic bands, however, third and sixth embodiments of this invention provided a pair of hinges to be used to pivotally connect the front and rear cowling members to the center cowling member at the tops thereof so that the front and rear cowling members or side cowling members can be opened up. Latch hooks and catch members releasably retain the front and rear or side cowling members in a closed position. Fourth and fifth embodiments of the invention use a pair of spring mechanisms for pivotally connecting and biasing the two side cowling members, or alternatively the front and rear cowling members, against the center cowling member at the tops thereof. Latch hooks and catch members are provided for releasably retaining the side or front and rear cowling members in a closed position. All of the embodiments include seal members held between adjoining edges of the cowling members to provide a water tight enclosure for the outboard motor engine.

13 Claims, 9 Drawing Sheets

COWLING ASSEMBLY FOR OUTBOARD MOTOR

BACKGROUND OF THE INVENTION

This invention relates to a cowling assembly for an outboard motor, and more particularly to an improved protective cowling assembly for the powerhead of an outboard motor.

It is well known with outboard motors that the powering internal combustion engine is normally enclosed within a protective cowling so as to provide protection for the internal combustion engine, to suppress engine noise, to protect users from contact with the engine, and to provide a better appearance for the outboard motor. The protective cowling defines a cavity in which the internal combustion engine is contained.

One type of cowling includes a top cover and a tray member that is affixed to the lower end of the internal combustion engine. The top cover has a generally inverted cup shape and is attachable to the tray member. When so attached, this top cover defines a cavity in which the engine is contained. While this type of cowling is generally satisfactory in performing the above functions, removal of the top cover in order to service the engine can be difficult, since it must be lifted above the engine to be removed. Lifting a large or heavy top cover above the engine can be difficult especially under adverse conditions such as high winds or cold weather.

Another type of cowling includes two side portions hinged together at the aft end of the engine and wrapped around the engine sides with the front portions thereof releasably connected to form a clam shell arrangement. This type of cowling is set forth in U.S. Pat. No. 4,600,396. Under normal operating conditions, water will generally not enter the interior of this type of cowling arrangement. However, since this type of cowling does not provide a water tight joint when the two side cowling portions are connected together, under extreme or adverse conditions, water may enter into the interior of the cowling and damage the engine or the electrical parts of the outboard motor, or enter the induction system of the engine.

It is, therefore, an object of this invention to provide an improved cowling assembly for the powerhead of an outboard motor which can be easily removed or opened for servicing the engine.

It is another object of this invention to provide an improved cowling assembly for the powerhead of an outboard motor which will prevent water from entering into the interior of the cowling.

SUMMARY OF THE INVENTION

A cowling assembly is provided for enclosing the engine of an outboard motor. The cowling assembly comprises a center cowling member secured to the engine and preferably removable, removable front and rear cowling members, and means for connecting the front and rear cowling members to the center cowling member to enclose the engine. The invention further includes means for sealingly engaging the front and rear cowling members to the center cowling member to provide a watertight enclosure for the engine.

A second embodiment of the invention comprises removable port and starboard cowling members instead of front and rear cowling members.

A third embodiment of the invention is generally similar to the first embodiment. In this embodiment, however, the connecting means includes a pair of hinges pivotally connecting the front and rear cowling members to the center cowling member at the tops thereof so that the front and rear cowlings can be opened up. Latch means are provided for latching the front and rear cowling members at the bottoms thereof to the center cowling member, or alternatively, to a tray member which can be secured to the lower end of engine.

A fourth embodiment of the cowling assembly is generally similar to the design of the second embodiment, except that in this embodiment, the connecting means includes a pair of spring mechanisms for pivotally connecting and biasing the port and starboard cowling members against the center cowling member at the tops thereof. As in the third embodiment, the invention includes latch means for latching the port and starboard members at the bottoms thereof to the center cowling member or to a tray member.

A fifth embodiment is provided which is similar to the third embodiment, except that in this fifth embodiment, the connecting means comprises the spring mechanisms described in the fourth embodiment, instead of hinges.

A sixth embodiment differs from the fourth embodiment only in that the hinges described with reference to the third embodiment are used as the connecting means instead of spring mechanisms.

DETAILED DESCRIPTION OF THE PREFERRED EMBODIMENTS

Figure 1:
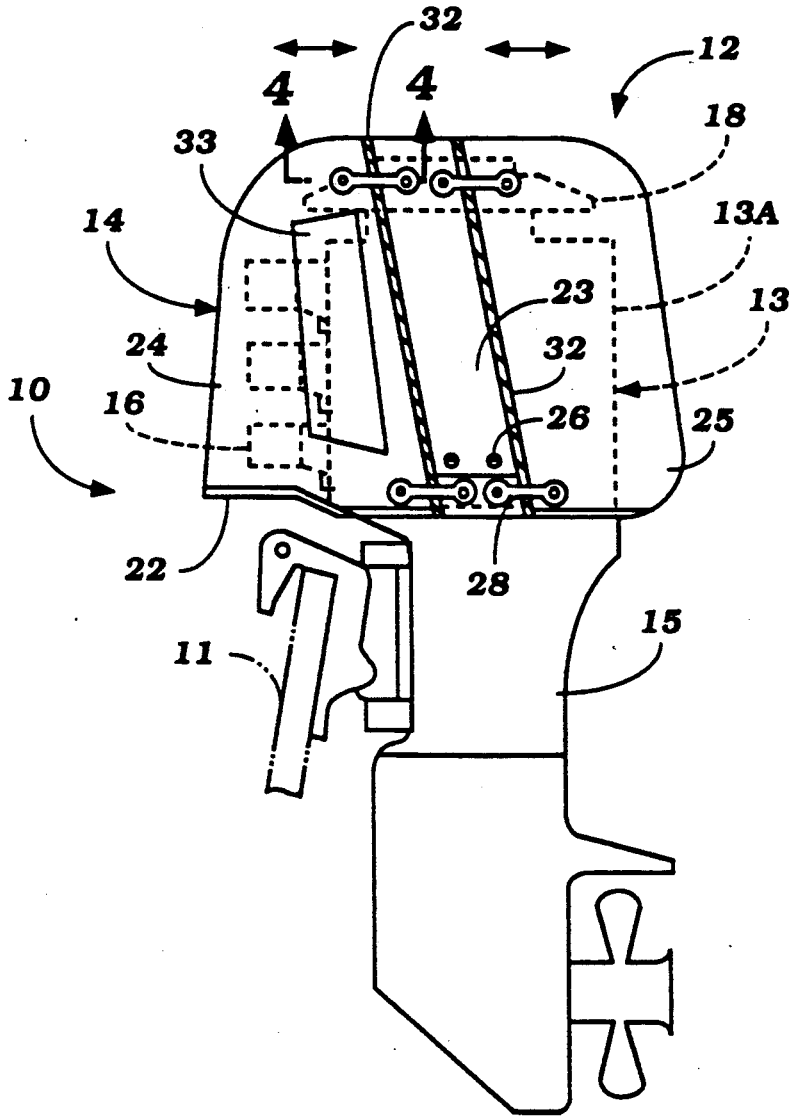
FIG. 1 is a side elevational view of an outboard motor incorporating a first embodiment of the cowling assembly of this invention.
Figure 2:
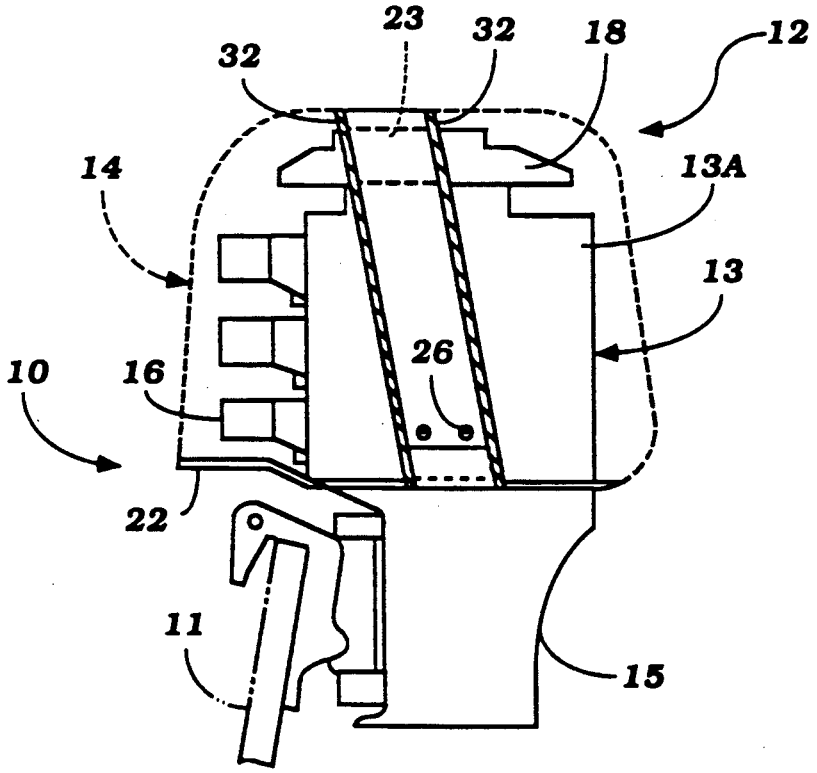
FIG. 2 is a side elevational view of the powerhead of an outboard motor showing a first embodiment of the cowling assembly with the front and rear cowling members removed.
Figure 3:
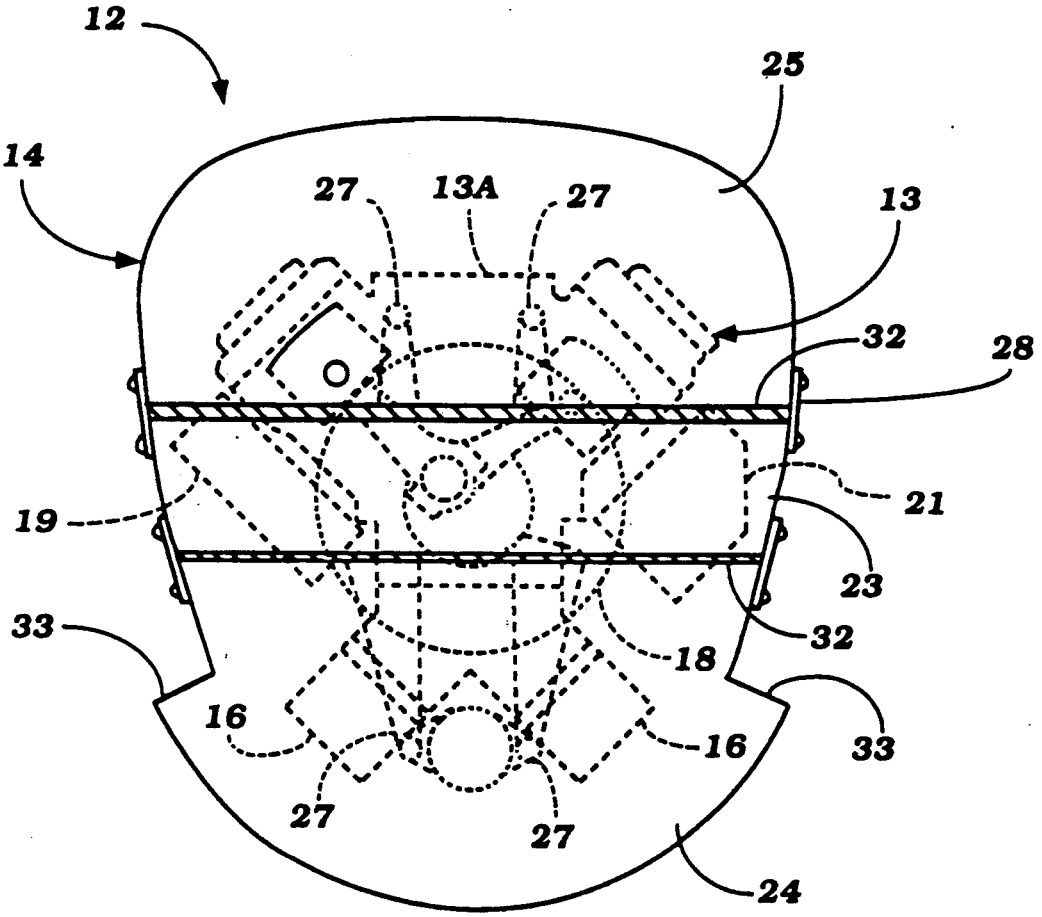
FIG. 3 is a top view of the powerhead of an outboard motor showing a first embodiment of the cowling assembly of this invention.

Referring first to FIG. 1, an outboard motor constructed in accordance with a first embodiment of the invention is identified generally by the reference numeral 10 and is shown as attached to a transom 11 of an associated watercraft. The outboard motor 10 includes a powerhead, indicated generally by the reference numeral 12, that contains an internal combustion engine 13 including an engine body 13A and Which is surrounded by a protective cowling assembly including a top cover 14 constructed in accordance with the first embodiment of the invention. The internal combustion engine 13 drives an output shaft which, in turn, drives a driveshaft which is journalled for rotation within a driveshaft housing 15 that depends from the powerhead 12. This driveshaft (not shown) drives a propeller of a lower unit by means of a conventional forward, reverse, neutral transmission (not shown).

Referring now in general to FIGS. 1 through 7 and FIG. 9, the engine 13 is comprised of a cylinder block in which a plurality of cylinder bores extend in a horizontal direction as is conventional in outboard motor practice. In the illustrated embodiments, an internal combustion engine 13 is depicted. It is to be understood, of course, that the invention may be utilized in conjunction with other types of engines, including electric engines.

Pistons are supported for reciprocation within each of these cylinder bores and are connected by means of connecting rods to a crankshaft. The crankshaft is rotatably journalled in a crankcase formed by the cylinder block and rotates about a generally vertically extending axis. The crankshaft is connected to the output shaft which drives the driveshaft as aforenoted.

A cylinder head is affixed to the cylinder block in a known manner and defines a plurality of individual recesses, each of which cooperate with a respective cylinder bore and piston so as to define combustion chambers which vary in volume as the pistons reciprocate. Spark plugs are mounted in the cylinder head with each of their gaps extending to a respective combustion chamber recess for a respective cylinder.

A fuel/air charge is delivered to these chambers by means of an induction and charge forming system. This induction and charge forming system includes an air intake device 16 that draws air from within the protective cowling assembly and delivers it to a plurality of carburetors.

The fuel/air charge is delivered to crankcase chambers formed within the crankcase by the carburetors and is transferred upon descent of the pistons into the combustion chambers by transfer or scavenge passages in a known manner. At the appropriate time, the spark plugs are fired.

The firing power for the spark plugs is derived from a magneto generator, which includes a flywheel magneto 18 that is affixed to the crankshaft for rotation with it by a key and a nut. The flywheel magneto 18 carries a plurality of permanent magnets that cooperate with a charging coil that is affixed to a boss of the cylinder block in proximity thereto. The engine 13 further includes a CDI ignitor 19 and an oil tank 21.

The construction of the outboard motor 10 as thus far described may be considered conventional and, for that reason, those components which are not illustrated and which have not been described in any more detail may take the form of any of the known components used in this field.

Referring now in detail to FIGS. 1 through 4, the cowling assembly of the powerhead 12 is comprised of a tray 22 that is affixed to the lower end of the internal combustion engine 13 and a top cover indicated generally by the reference numeral 14 and preferably formed from a lightweight plastic material. The top cover 14 has a generally inverted cup shape and comprises a center cowling member 3 and front and rear cowling members 24 and 25 respectively. The center cowling member 23 is removably secured to the sides of the engine 13 by bolts 26 or other suitable means and is removably secured to the top of the engine 13 by stays 27. The front and rear cowling members 24 and 25 are, in turn, connected to the side portions of the center cowling member 23 by elastic bands 28 or other suitable connecting means. In the illustrated embodiment, eight (8) elastic bands 28 are provided, four (4) for connecting the front cowling member 24 to the center cowling member 23 and four (4) for connecting the rear cowling member 25 to the center cowling member 23.

Figure 4:
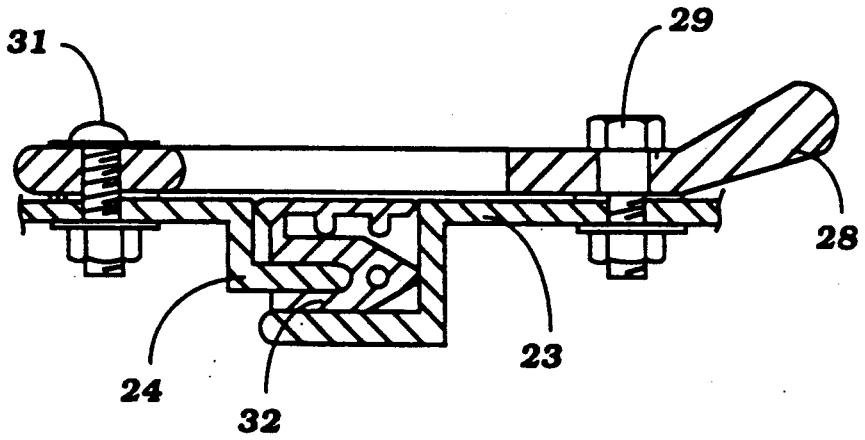
FIG. 4 is an enlarged cross sectional view taken along line IV—IV in FIG. 1 showing the connecting means of the first embodiment of this invention.

The center cowling member 23 has a plurality of apertures, four (4) on the starboard side portion and four (4) on the port side portion. Two (2) apertures are positioned at the top of each side portion and two (2) at the bottom of each side portion. These apertures are adapted to receive the screw threaded ends of hook members 29, as illustrated in FIG. 4. A middle portion of each hook member 29 which is coaxial with the screw threaded end but of wider diameter than that end and the aperture, extends outward in a horizontal direction from the center cowling member 23 when the inner middle portion is brought into firm engagement with the outer wall of the center cowling member 23. This middle portion is adapted for engagement with a elastic band 28, as shown in detail in FIG. 4. A nut abuts the inner wall of the center cowling member 23 to hold each hook member 29 firmly in place. Corresponding bolts 31, two (2) received within apertures on each of the sides of the front and rear cowling members 24 and 25 and paired with a corresponding hook member 29, extend horizontally outward for engagement with the elastic bands 28.

To connect the front and rear cowling members 24 and 25 to the center cowling member 23, each of the elastic bands 28 are stretched between a bolt 31 and a corresponding hook member 29. The biasing force exerted by the elastic bands 28 serves to hold the cowling members together so as to enclose the engine 13. Seal members 32 are positioned between the adjoining edges of the center and front cowling members 23 and 24 and between the center and rear cowling members 23 and 25 to provide a water tight enclosure for the engine 13.

Two sidewardly facing air inlet devices 33 in the front cowling member 24 are adapted for inducting air from the atmosphere and providing air for the engine induction system.

Figure 5:
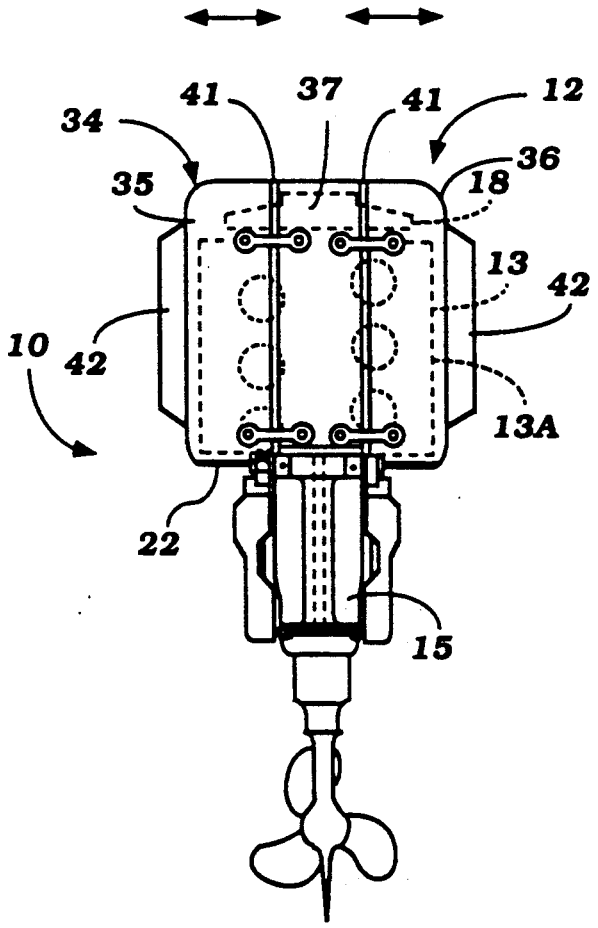
FIG. 5 is a front view of an outboard motor showing a second embodiment of this invention.
Figure 6:
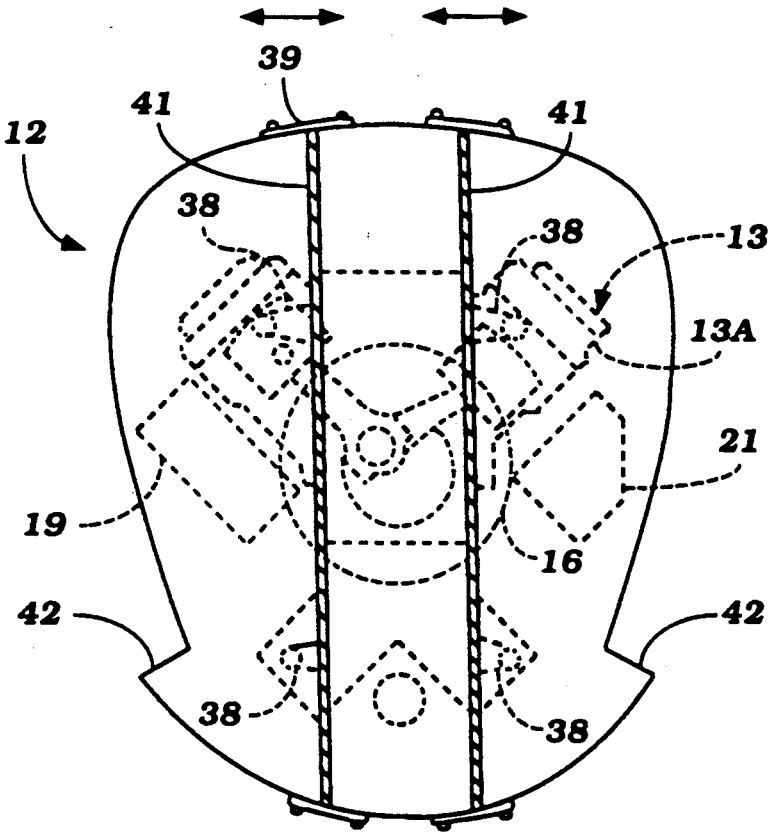
FIG. 6 is a top view of FIG. 5.

FIGS. 5 and 6 illustrate a second embodiment of the invention, which differs from the first embodiment in that the top cover 34 includes removable starboard and port cowling members 35 and 36 respectively instead of front and rear cowling members 24 and 25. As in the first embodiment, a center cowling member 37 is provided. However, the top portion of this center cowling member 37 is parallel with the center line of the watercraft and is removably affixed to the top of the engine 13 by stays 38.

A plurality of apertures are provided, four (4) each on the front and rear sides of the center cowling member 37. The front side of center cowling member 37 has two (2) apertures at the top and two (2) at the bottom, as does the rear side of the center cowling member 37. As previously described these apertures are designed to receive hook members 29 which are, in turn, adapted for engagement with elastic bands 39. A nut secures each hook member 29 securely in place. The front and rear portions of the starboard and port cowling members 35 and 36 have corresponding apertures therein for receiving bolts 31. Each bolt 31 is paired with a corresponding hook member 29 so that when each elastic band 39 is stretched between a corresponding hook member 29 and bolt 31, the biasing force of the elastic bands 39 holds the cowling members together to enclose the engine 13. Seal members 41 are held between the adjoining edges of the starboard and center cowling members 35 and 37 and between the port and center cowling members 36 and 37 to provide a water tight enclosure for the engine 13.

This embodiment further includes two sidewardly facing air inlet devices 42, one in each of the starboard and port cowling members 35 and 36 for inducting air from the atmosphere and providing air for the engine induction system.

Figure 7:
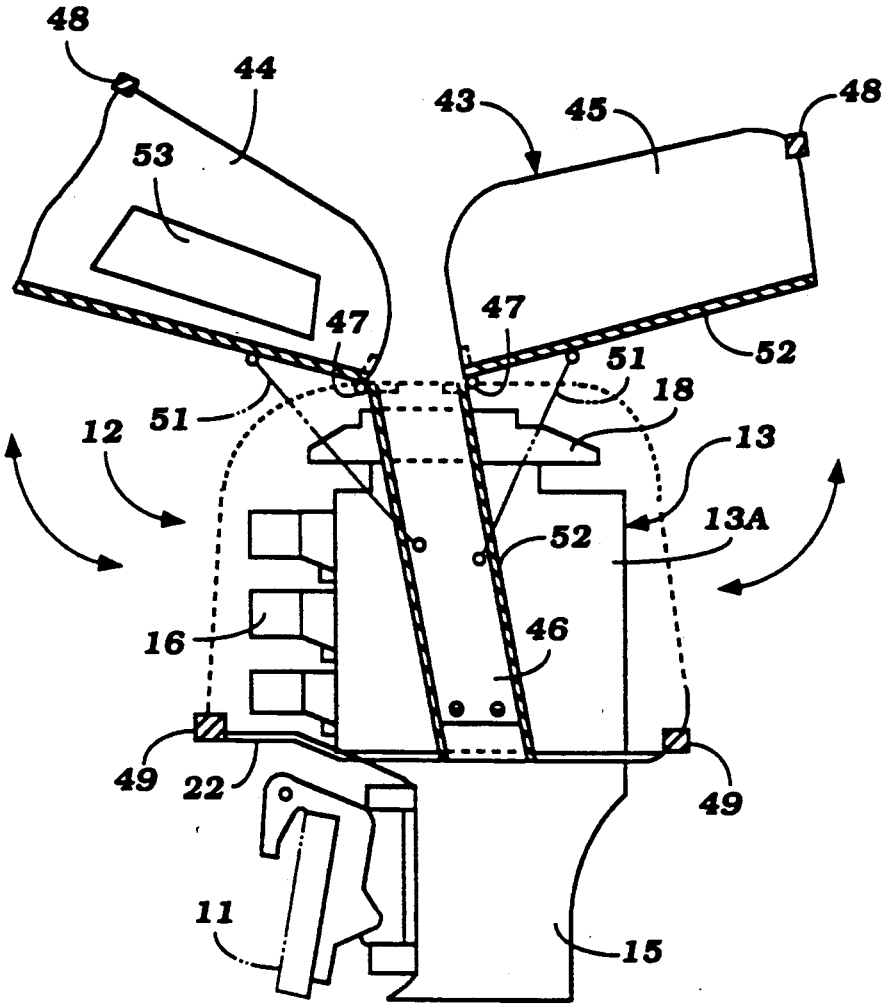
FIG. 7 is a side elevational view of the powerhead of an outboard motor showing a third embodiment of this invention.

Referring now to FIG. 7, a third embodiment of the invention is illustrated, the top cover 43 of which is generally similar in construction with the top cover 14 of the first embodiment. The top cover 43 includes front and rear cowling members 44 and 45, each of which is pivotally connected to a removable center cowling member 46 at the tops thereof by a hinge 47.

Figure 8:
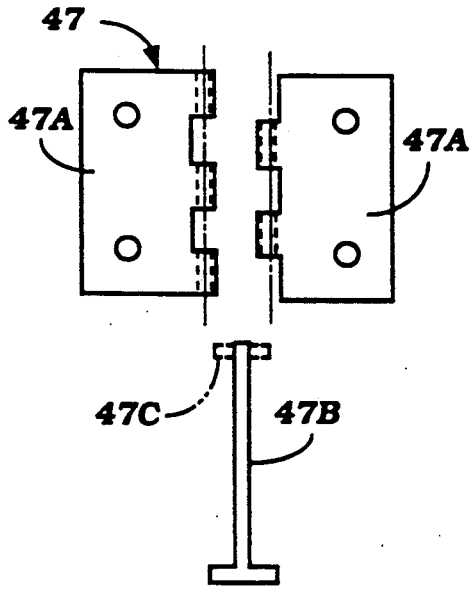
FIG. 8 is a detailed side view of a hinge of the third embodiment.

FIG. 8 shows a detailed view of a hinge 47 which includes two plate members 47A, each having sleeve-like members on one end. The sleeve-like members are spaced apart so that the plate members 47A can be brought together and joined by a hinge pin 47B. When the plate members 47A are brought together their adjoining sleeve-like members are coaxial with each other. The hinge pin 47B is then inserted into the sleeve-like members to pivotally connect the plate members 47A together. The hinge pin 47B has a head at one end and a radial aperture at the other end for receiving a removable cotter pin 47C. The head, and cotter pin 47C when in place, serve to prevent inadvertent removal of the hinge pin 47B. The plate members 47A have apertures therein for screw or bolt attachment to the cowling members.

Referring again to FIG. 7, latch means are provided for latching the front and rear cowling members 44 and 45 at the bottoms thereof to the tray 22 so as to enclose the engine 13. The latch means includes two latch hooks 48, one each respectively positioned on the bottom portions of the front and rear cowling members 44 and 45. Corresponding catch members 49 are provided on the front and aft ends of the tray 22, which cooperate with the latch hooks 48 to releasably retain the front and rear cowling members 44 and 45 in a closed position. Alternatively, the catch members 49 can be positioned on the sides of the center cowling member 46. A pair of holding arms 51 are pivotally attached at one end to a side of the center cowling member 46 by means of pins so that the holding arms 51 can move about a vertical plane generally parallel with the side of the powerhead 12. The other ends of the holding arms 51 are adapted for engagement with grooves in the side edges of the front and rear cowling members 44 and 45 to hold those cowling members in the open position, as shown in FIG. 7. Apertures in a side bottom portion of the center cowling member 46 or in the side of the outboard motor can be provided to releasably retain the holding arms 51 when the front and rear cowling members 44 and 45 are closed.

Seal members 52 provide a water tight enclosure for the engine 13, as previously described. The outboard motor 10 further includes two sidewardly facing air inlet devices 53 on the front cowling member 44 for drawing in atmospheric air for the engine induction system.

Figure 9:
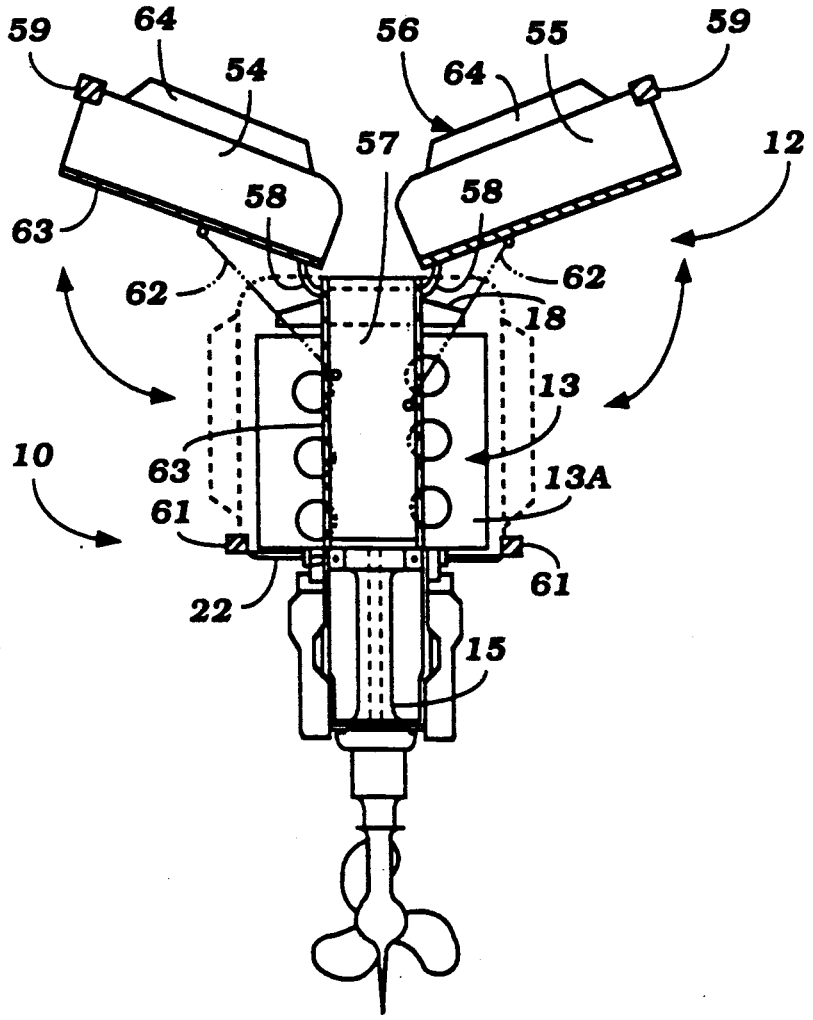
FIG. 9 is a front view of an outboard motor showing a fourth embodiment of this invention.

FIG. 9 illustrates a fourth embodiment of the invention which is generally similar in design to the second embodiment. In this embodiment, however, the starboard and port cowling members 54 and 55 respectively of the top cover 56 are pivotally connected to the center cowling member 57 at the tops thereof, by a pair of spring mechanisms 58. The spring mechanisms 58 pivotally bias the starboard and port cowling members 54 and 55 against the center cowling member 57 at the tops thereof so that the starboard and port cowling members 54 and 55 are automatically opened when they are unlatched from the tray 22 or center cowling member 57. The latching means provided in this embodiment includes two (2) latch hooks 59, one on each of the bottom portions of the starboard and port cowling members 54 and 55 and corresponding catch members 61 on the front and aft ends of the tray 22. Alternatively, the catch members 61 can be positioned on the front or aft ends of the center cowling member 57. The latching means operates as previously described with respect to FIG. 7. Holding arms 62 are also provided to assist the spring mechanisms 58 in supporting the starboard and port cowling members 54 and 55 in the open position.

Seal members 63 provide a watertight enclosure for the engine as previously described. Two sidewardly facing air inlet devices 64 are provided as described with reference to FIGS. 5 and 6.

Figure 10:
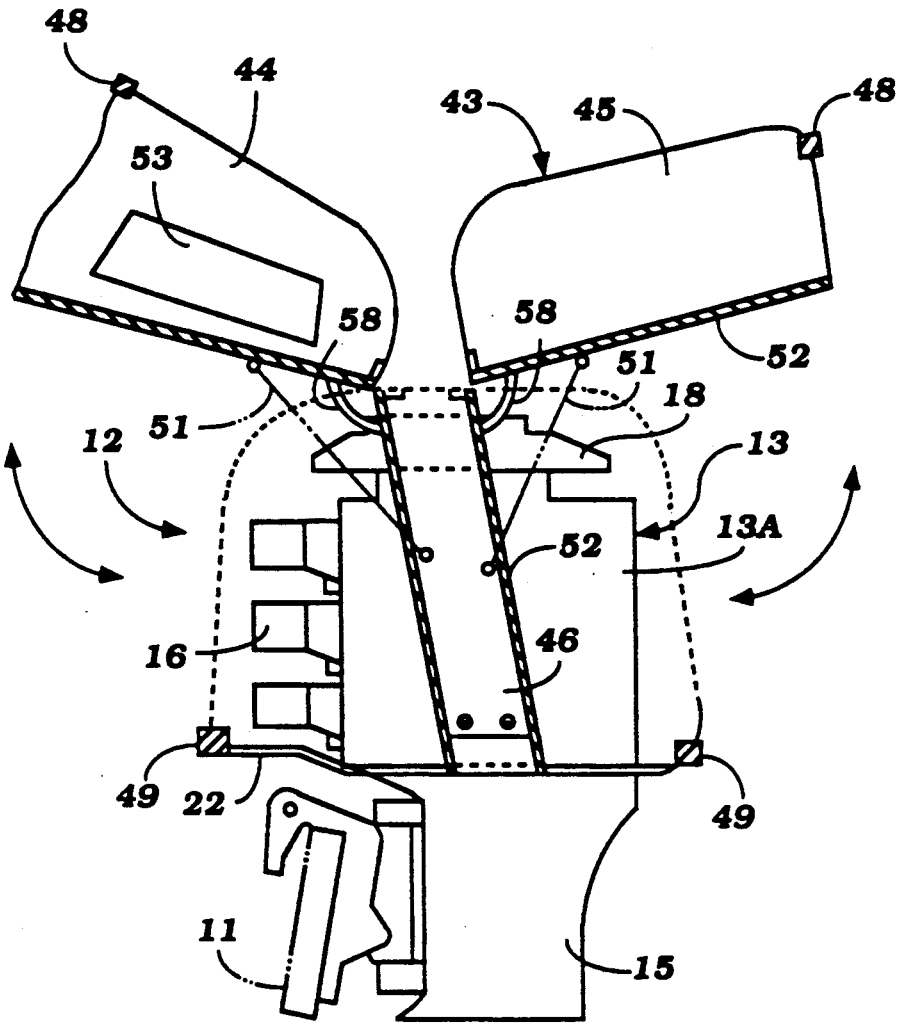
FIG. 10 is a side elevational view of the powerhead of an outboard motor showing a fifth embodiment of the invention.

FIG. 10 illustrates a fifth embodiment of the invention, which is similar to the third embodiment shown in FIG. 7, except that in this fifth embodiment the front and rear cowling members 44 and 45 are pivotally connected to and biased against the center cowling member 46 at the tops thereof by the spring mechanisms 58 of FIG. 9, instead of hinges 47.

Figure 11:
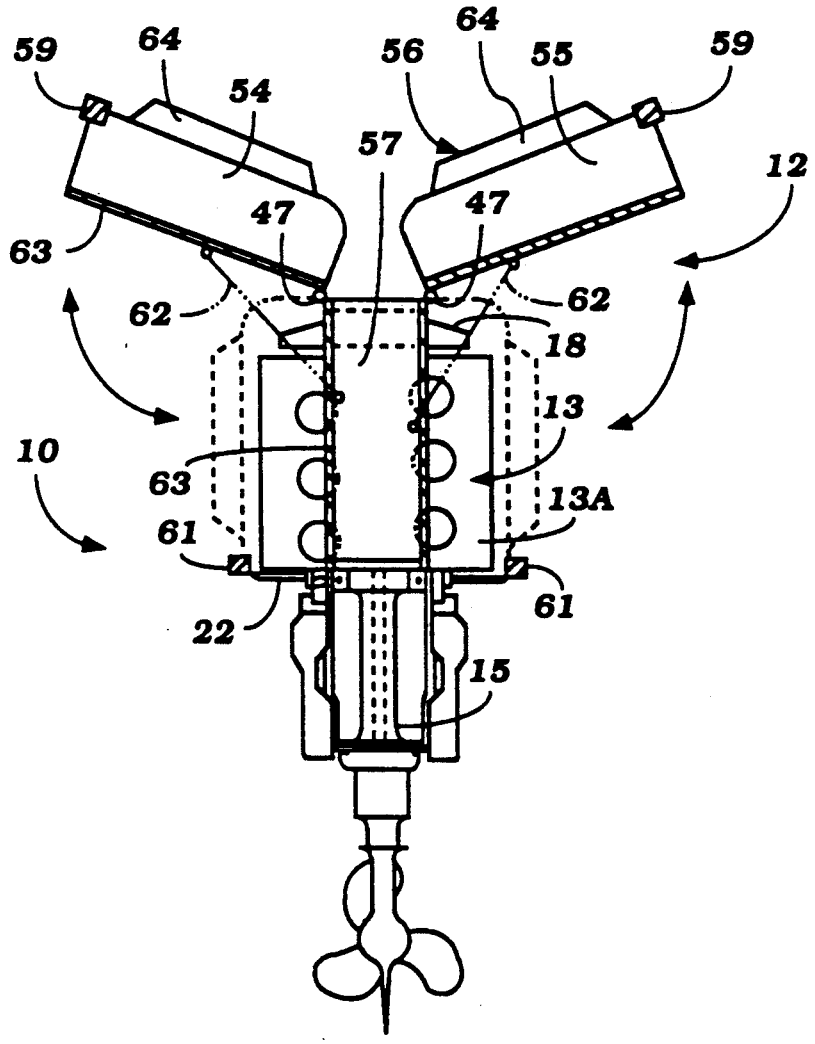
FIG. 11 is a front view of an outboard motor showing a sixth embodiment of the invention.

FIG. 11 shows a sixth embodiment of the invention which differs from the fourth embodiment only in that the hinges 47 described with reference to FIGS. 7 and 8 are used to pivotally connect the starboard and port cowling members 54 and 55 to the center cowling member 57 at the tops thereof, instead of the spring mechanisms 58.

Although several embodiments of the invention have been illustrated and described, various changes or modifications may be made in the embodiments without departing from the spirit and scope of the invention as defined by the appended claims.

We claim:

1. A cowling assembly for enclosing the engine of an outboard motor, comprising a center cowling member secured to sad engine, a removable front cowling member, a removable rear cowling member covering the rear of the engine and portions of the port and starboard sides of the engine, means for connecting said front and rear cowling members to said center cowling member to enclose said engine, and means for sealingly engaging said front and rear cowling members to said center cowling member to provide a water tight enclosure for said engine.

2. A cowling assembly as recited in claim 1, wherein said center cowling member is removable.

3. A cowling assembly as recited in claim 2, wherein said connecting means comprises elastic bands.

4. A cowling assembly as recited in claim 1, wherein said connecting means comprises a pair of hinges, one pivotally connecting said front cowling member to said center cowling member at the tops thereof and the other pivotally connecting said rear cowling member to said center cowling member at the tops thereof, said connecting means further comprising latch means for latching said front and rear cowling members at the bottoms thereof to enclose said engine.

5. A cowling assembly as recited in claim 7, further comprising a pair of holding arms to hold said front and rear cowling members in an open position.

6. A cowling assembly as recited in claim 1, wherein said connecting means comprises a pair of spring mechanisms, one pivotally biasing said front cowling member against said center cowling member and the other pivotally biasing said rear cowling member against said center cowling member.

7. A cowling assembly as recited in claim 6, wherein said connecting means further comprises latch means for latching said front and rear cowling members to enclose said engine.

8. A cowling assembly for enclosing the engine of an outboard motor, comprising a center cowling member secured to said engine and extending along the middle portion of the top of the engine and downwardly along the middle portions of the front and rear of the engine, a removable port cowling member, a removable starboard cowling members to said center cowling member to enclose said engine comprising a pair of hinges, one pivotally connecting said port cowling member to said center cowling member and the other pivotally connecting said starboard cowling member to said center cowling member, and means for sealingly engaging said port and starboard cowling members to said center cowling member to provide a watertight enclosure for said engine.

9. A cowling assembly as recite din claim 8, wherein said center cowling member is removable.

10. A cowling assembly as recited in claim 9, wherein said connecting means further comprises elastic bands.

11. A cowling assembly as recited in claim 8, wherein said connecting means further comprises a pair of spring mechanisms, one pivotally biasing said port cowling member against said center cowling member at the tops thereof and the other pivotally biasing said starboard cowling member against said center cowling member at the tops thereof, said connecting means further comprising latch means for latching said port and starboard cowling members at the bottoms thereof to enclose said engine.

12. A cowling assembly as recited in claim 11, further comprising a pair of holding arms to assist in holding said port and starboard cowling members in an open position.

13. A cowling assembly as recited in claim 8, wherein said connecting means further comprises latch means for latching said port and starboard cowling members to enclose said engine.

* * * * *

UNITED STATES PATENT AND TRADEMARK OFFICE

CERTIFICATE OF CORRECTION

PATENT NO. : 5,052,961

DATED : October 1, 1991

INVENTOR(S) : Uchida, et al

It is certified that error appears in the above-identified patent and that said Letters Patent is hereby corrected as shown below:

On the title page, item [56] U.S. Patent Documents, insert the following:

--4,600,393 7/1986 Crane et al--

Abstract line 3, "emmber" should be --member--.

Abstract line 14, "provided" should be --provide--.

Column 6, line 52, Claim 1, "sad" should be --said--.

Column 7, line 6, Claim 5, "7" should be --4--.

Column 7, line 25, Claim 8, after "cowling" (first occurrence) insert --member, means for connecting said port and starboard cowling--.

Column 8, line 6, Claim 9, "recite din" should be --recited in--.

Signed and Sealed this

Sixteenth Day of November, 1993

*Attest:*

*Attesting Officer*

Bruce Lehman

BRUCE LEHMAN

*Commissioner of Patents and Trademarks*